United States Patent [19]

Litchfield et al.

[11] 4,304,449

[45] Dec. 8, 1981

[54] DRAWERS

[75] Inventors: Leon G. Litchfield; Terence Hardy, both of Belper, England

[73] Assignee: L. B. (Plastics) Limited, Belper, England

[21] Appl. No.: 31,018

[22] Filed: Apr. 17, 1979

Related U.S. Application Data

[63] Continuation-in-part of Ser. No. 816,039, Jul. 15, 1977, Pat. No. 4,162,114.

[30] Foreign Application Priority Data

Apr. 26, 1977 [GB] United Kingdom ..... 17290/77
May 30, 1978 [GB] United Kingdom ..... 24424/78

[51] Int. Cl.[3] ..... A47B 88/10
[52] U.S. Cl. ..... 312/341 R; 308/3.6; 312/344; 312/347
[58] Field of Search ..... 312/330 R, 330 SM, 331, 312/334, 341 R, 344, 348, 333; 308/3.6, 3.8

[56] References Cited

U.S. PATENT DOCUMENTS

| | | | |
|---|---|---|---|
| 614,923 | 11/1898 | Alter et al. | 312/341 R |
| 3,008,790 | 11/1961 | Simons | 312/348 |
| 4,119,377 | 10/1978 | Barber et al. | 312/341 R |
| 4,186,979 | 2/1980 | Litchfield | 312/348 |
| 4,196,943 | 4/1980 | Röck et al. | 312/34.8 |

FOREIGN PATENT DOCUMENTS

| | | | |
|---|---|---|---|
| 2752780 | 6/1978 | Fed. Rep. of Germany | 312/330 R |
| 1341399 | 12/1973 | United Kingdom | 312/330 R |

*Primary Examiner*—Roy D. Frazier
*Assistant Examiner*—Alexander Grosz
*Attorney, Agent, or Firm*—C. O. Marshall, Jr.

[57] ABSTRACT

A drawer assembly comprising a drawer slidably supported on a pair of drawer runners each comprising an elongated member of angle section having a mounting flange by means of which the runner may be mounted at a suitable location in a drawer cabinet or like supporting structure, and a drawer-engaging flange projecting at right angles to the mounting flange and adapted to extend into a runner recess formed in the drawer side, and means for taking up lateral clearance between the drawer and the drawer runners.

8 Claims, 13 Drawing Figures

DRAWERS

The invention relates to drawers and to parts and components for drawers and is a Continuation-in-Part of Application Ser. No. 816,039 filed July 15, 1977 now U.S. Pat. No. 4,162,114.

The invention is particularly concerned with so-called "knock-down" drawers constructed of plastics comprising hollow extruded wall panels having slots therein for accommodation of the drawer floor and adapted to be interconnected at right angles to one another by corner pieces having projecting spigots engageable in the ends of the panels. The invention is however also applicable to other forms of drawer.

One of the problems in relation to drawers is that a clearance requires to be left between the respective runner grooves in the opposite sides of the drawer and the runners on which the drawer is mounted in use. The clearance is necessary both to enable the drawer to slide easily between open and closed positions and to allow for manufacturing tolerances, and this can result in excessive side movement giving the drawer a "sloppy" feel during sliding movement.

It is an object of the present invention to obviate or mitigate this difficulty.

According to the invention there is provided a component for mounting on a drawer or a drawer runner and incorporating resilient means serving to take up lateral clearance between the drawer and the runner arising from variations in manufacturing tolerances.

The component may be adapted to be engaged with the runner recess of the drawer such that the resilient member projects laterally from the inner wall of the recess whereby to engage the inner face of the associated runner in use.

Alternatively the component may be adapted to be mounted on the drawer runner such that said resilient member projects laterally from the runner into engagement with the inner wall of the runner recess in the drawer.

Advantageously the component may be a guide and bearing member carried by the drawer runner and extending into the runner recess in the associated side of the drawer for sliding movement relative thereto during opening and closing movements of the drawer, bearing means being provided on the upper surface of the component for engagement with the upper wall of the runner recess.

The guide and bearing member may comprise a body portion having an outwardly opening slot adapted to engage with a flange on the associated drawer runner, said resilient means comprising a leaf spring carried by a wall of the body member opposite to that from which said slot opens for resilient abutment with the inner wall of the associated runner recess in the drawer.

Where the component is adapted for engagement in the drawer runner recess it may comprise a rear guide and bearing member in the form of an insert adapted to be removably mounted at the rear of the drawer runner recess. In this case the resilient member may comprise a spring tongue projecting outwardly from the insert into the runner recess for engagement with the associated drawer runner during use of the drawer.

In another embodiment for use in association with a runner having a roller or skid at its forward end for engagement in the runner recess of a drawer, and a horizontal flange slidably engageable with a guide and bearing member at the rear end of the drawer to support same during sliding movement of the drawer, the component is adapted to be mounted on said horizontal flange of the runner so as to extend into the runner recess in the drawer, and incorporates at least one resilient projection adapted for engagement with a portion of the drawer runner recess and so disposed as to apply lateral pressure to the drawer and hence take up lateral clearance between the drawer and the runner.

This embodiment may be adapted for use in association with a drawer in which the runner recess is provided with opposed longitudinally-extending lips projecting across the mouth thereof, said resilient projection being so directed as to act against the inner face of at least one of said longitudinal lips. Alternatively the resilient projection may act against the vertical wall which constitutes the back of the runner recess.

Preferably a pair of opposed resilient projections are provided which are disposed side-by-side in the same horizontal plane and have their free ends directed towards one another.

The component is preferably located towards the forward end of the runner and may be detachably mounted thereon. Preferably the component including the resilient projection or projections is formed as an integral molding from plastics materials.

In an alternative embodiment for use with a drawer construction of the kind shown in our co-pending application Ser. No. 923,795 now U.S. Pat. No. 4,186,979 the resilient means comprise resilient fingers associated with the retractible guide members mounted at the rear corners of the drawer and movable therewith into and out of engagement with the associated drawer runners when the guide members are moved between their operative and retracted positions.

Embodiments of the invention will now be described, by way of example only, with reference to the accompanying drawings, in which.

Figure 1:
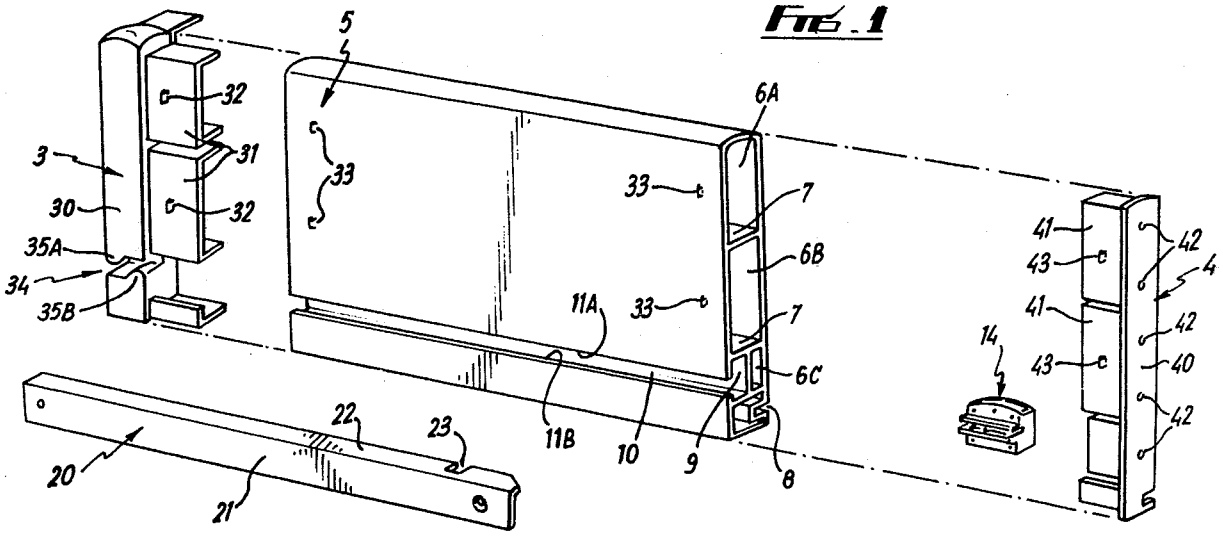
FIG. 1 is an exploded perspective view showing part of one form of drawer and associated runner incorporating the invention.

The drawers shown in the drawings are of so called "knock-down" construction, the sides and back comprising identical extruded hollow panels interconnected at right angles to one another by corner pieces having projecting spigots which engage in the ends of the panels. The forward ends of the side panels are connected to the drawer front by means of end connectors, and inwardly directed slots are provided adjacent the lower edges of the panels to receive the edges of a drawer bottom. In FIG. 1 the drawer side panel is shown at 5, the corner pieces at 3 and the end connectors at 4.

The drawer panel comprises upper, intermediate and lower hollow sections 6A, 6B and 6C separated by internal webs 7. An inwardly directed recess 8 is formed adjacent the lower longitudinal edge of the panel to accommodate an edge of a drawer bottom (not shown). The lower hollow section 6C of the panel incorporates a longitudinal channel 9 the entrance to which comprises a narrow slot 10 defined between upper and lower longitudinal lips 11A, 11B extending across the channel 9 towards one another so as to partially enclose same. The channel 9 constitutes an integral runner track or recess designed to accommodate a guide and bearing member 14.

Figure 2:
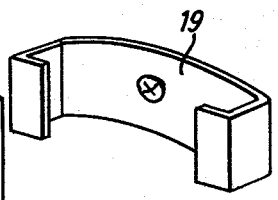
FIG. 2 is an enlarged exploded perspective view of a guide and bearing member incorporated in the drawer construction shown in FIG. 1.
Figure 2:
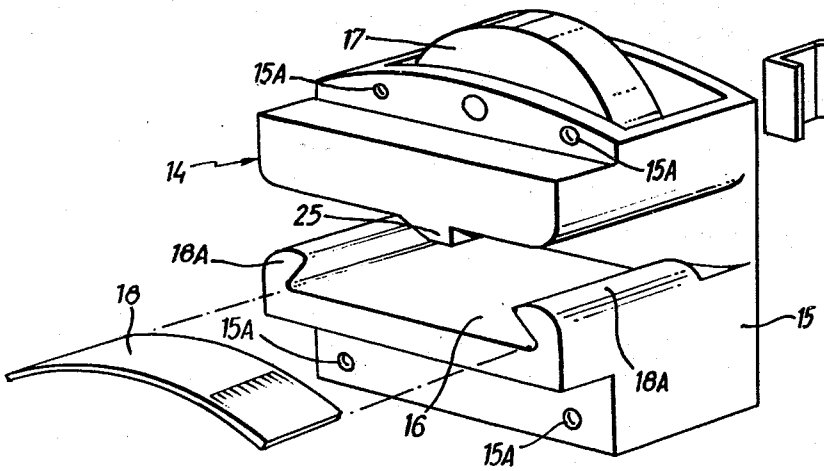

The guide and bearing member is shown in greater detail in FIG. 2 and comprises a body portion or carriage 15 formed with a through track or slot 16 and surmounted by a rotatable roller 17. A curved leaf spring 18 is located in the bottom of the track 16 between interned lips 18A, and a further curved leaf spring 19 engages with the portion of the body 15 defining the back or inner wall of the recess 16 so as to project therefrom in the opposite direction from the recess, that is laterally of the drawer. Pips 15A project from the faces of the body portion which engage the lips 11A, 11B of the track 9 to reduce frictional contact. Similar pips (not shown) are provided on the underside of the body portion.

In use the guide and bearing member is located in the track 9 with the roller 17 uppermost and the recess or slot 16 in alignment with the narrow entrance 10 to the track 9. The member is retained in the track by the lips 11A, 11B and by the corner piece 3 and front connector 4 which are located in the ends of the drawer panel when the drawer is assembled.

The guide and bearing member is adapted for engagement with a fixed drawer runner 20 of angle form and L-shaped cross-section having a mounting flange 21 by means of which the runner may be mounted in a suitable position in a cabinet or like housing in which the drawer is to be slidably located, and a drawer-engaging flange 22 which projects at right angles from the mounting flange and is adapted to extend into the channel 9 for locking engagement with the guide and bearing member. For this purpose a notch 23 is formed adjacent the forward end of the drawer-engaging flange 22 and is adapted to engage with the guide and bearing member to retain same in a fixed position on the runner 20. A downwardly directed projection 25 is formed on the upper surface of the slot 16 in the guide and bearing member and engages with the notch 23 in the runner 20, engagement being maintained by virtue of the spring 18 urging the guide and bearing member downwardly and thereby retaining the projection 25 in the notch.

The spring 19 serves to urge the guide and bearing member bodily away from the back or inner wall of the track 9 and accommodates differences in tolerance of the drawer components introduced during manufacture by allowing the guide and bearing member to adopt different positions in the track 9 dependent on the extent to which the runner flange 22 extends into the track. It will be appreciated that since a guide and bearing member 14 is provided at each side of the drawer, the springs 19 have a self-centering effect in addition to taking up the clearances between the drawer and the runners on which it is mounted.

The corner pieces 3 each comprise an upstanding corner post 30 having spigot members 31 projecting therefrom at right angles and spaced and dimensioned so as to form a tight push fit in the upper, intermediate and lower cavities of the associated wall panels. Detents 32 are provided on the two uppermost projections 31 and engage in holes 33 formed in the outer face of the wall panel adjacent to the end thereof. Towards its lower end the post 30 is provided with a through slot 34 for accommodation of the flange 22 of the runner 20. Opposed curved bearing surfaces 35A, 35B are formed at the recess 34 to facilitate sliding movement and reduce wear. If desired these bearing surfaces may be replaced by separate inserts of wear-resistant material. Alternatively, a roller or rollers could be incorporated. The slot 34 thus provides a guide and bearing member for supporting the rear end of the drawer during sliding movement.

The front connecting member 4 comprises a face plate 40 provided with spigot members 41 similar to the spigots or projections 31 formed on the corner connectors 3 and adapted for engagement in the hollow ends of the associated side wall panels. Prior to insertion of the front connectors into the wall panels they are secured to a suitable facia panel or drawer front by screws passed through holes 42 in the face plate 40, whereupon the assembly comprising the facia panel and the two front connectors is engaged with the open forward ends of the side panels, the drawer bottom having been inserted in the meantime. The front connecting members are secured to the wall panels by detents 43 on the spigot members 41 engaging in holes 33 in the forward ends of the wall panels.

In use, the drawer is supplied to the customer in disassembled condition and is erected by inserting the corner pieces 3 in the open ends of the side and back panels thereby joining same together at right angles to one another. Thereafter the guide and bearing members 14 may be inserted in the tracks 9 in the side walls and the drawer bottom engaged in the slots 8. The front connectors 4 are then secured to the facia panel in suitable positions corresponding to the spacing of the drawer sides and the assembly comprising the facia panel and the front connectors is then engaged with the remainder of the drawer by pushing the front connectors into the hollow ends of the side wall panels. The guide and bearing members are then trapped within the tracks 9 at opposite sides of the drawer but are free to slide longitudinally thereof.

The drawer may then be inserted in the cabinet or the like in which it is to be housed and which is first of all provided with opposed runners 20. The drawer may be engaged with the runners by simply pushing it into the opening in the cabinet to its fully closed position in which the projections 25 on the guide and bearing members reach the notches 23 in the respective runners. The guide and bearing members then lock on to the associated runners and are retained in position, the drawer being free to slide along the runners between the limits defined by engagement of the guide and bearing members with the corner pieces and front moldings which are disposed at opposite ends of the tracks 9. If it is desired to release the drawer from the cabinet the springs 18 are depressed by lifting the front of the drawer, thereby allowing the guide and bearing members to be disengaged from the slots 23 whereupon the drawer can be drawn completely out of the cabinet.

Figure 3:
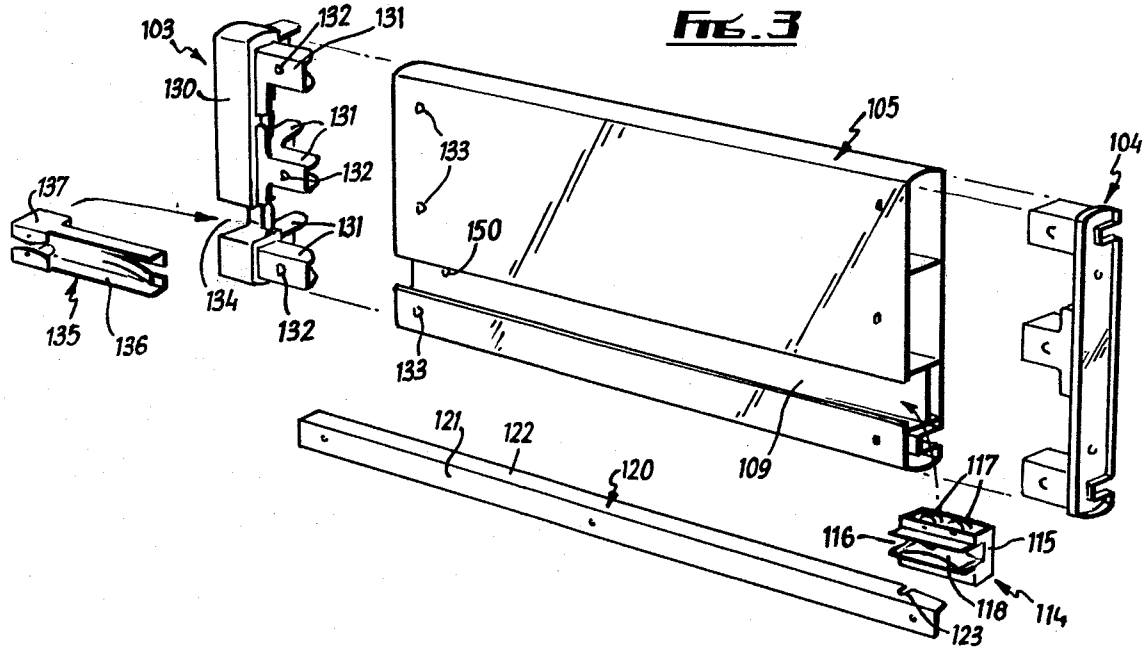
FIG. 3 is an exploded perspective view showing part of a modified form of drawer and runner.
Figure 5:
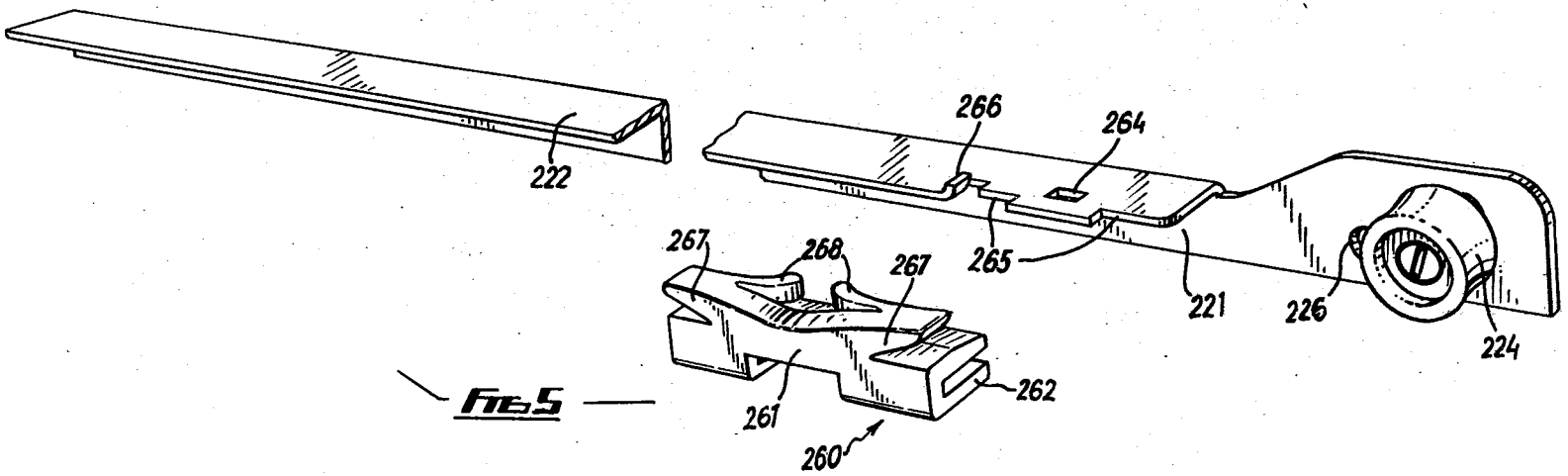
FIG. 5 is a perspective view of a drawer runner and a device for taking up lateral tolerance positioned adjacent thereto.
Figure 6:
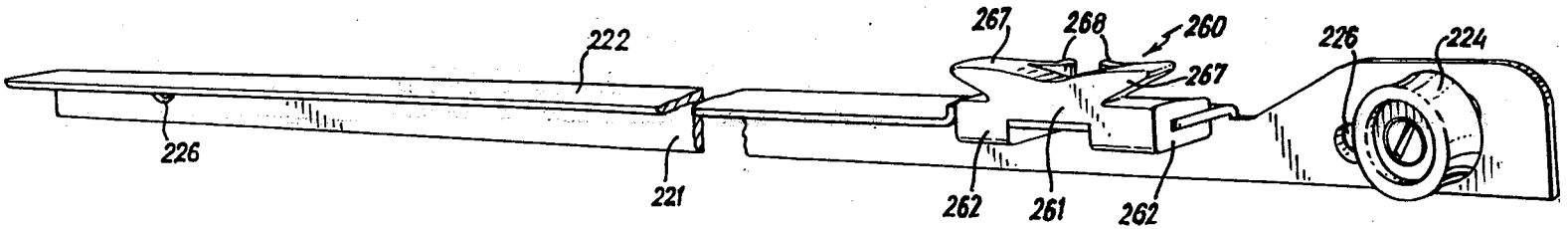
FIG. 6 is a view similar to FIG. 5 showing the device mounted on the runner.
Figure 7:
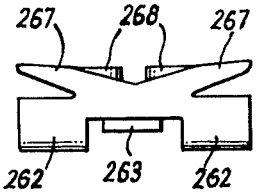
FIG. 7 is a side elevation of the device.
Figure 8:
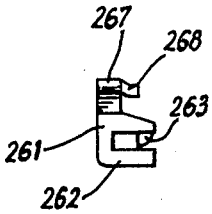
FIG. 8 is an end view of the device.
Figure 9:
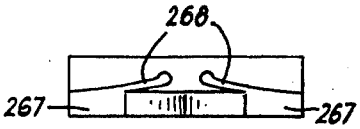
FIG. 9 is a plan view of the device.

FIG. 3 shows a modification of the drawer shown in FIG. 1. The drawer side panel is shown at 105, a corner piece at 103 and an end connector for connecting the drawer side to a suitable facia panel at 104. Guide and bearing members 114 similar to the guide and bearing members 14 shown in FIGS. 1 and 2 are provided, and are adapted to be accommodated in the channels 109 in the drawer side panels. Each guide and bearing member comprises a body portion 115 formed with a through track or slot 116 and surmounted by a pair of rotatable wheels or rollers 117. A curved leaf spring 118 is located in the bottom of the track 116 but in this instance there is no leaf spring equivalent to the leaf spring 19 of FIGS. 1 and 2. The guide and bearing member 114 is adapted to be mounted on a runner 120 similar to the runner shown in FIG. 1.

Figure 4:
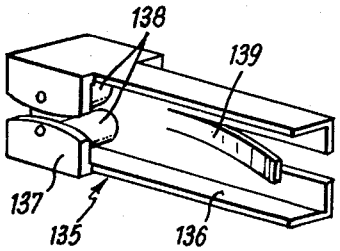
FIG. 4 is an enlarged perspective view of a guide and bearing member incorporated in the drawer construction shown in FIG. 3.

The corner pieces 103 each comprise an upstanding corner post 130 having spigot members 131 projecting therefrom at right angles and spaced and dimensioned so as to form a tight push fit in the upper, intermediate and lower cavities of the associated wall panels. Detents 132 are provided on the spigot members 131 and engage in holes 133 formed in the outer face of the wall panel adjacent to the end thereof. Toward its lower end the post 130 is provided with a through opening 134 for accommodation of an insert 135 which co-operates with the runner 120 in use, and is shown in greater detail in FIG. 4.

The insert 135 comprises a locating part 136 and a bearing or body part 137. The insert is located in the opening 134 in the corner post 130 after the drawer has been assembled and the locking part 136 extends beyond the corner post into the channel 109. A detent (not shown) similar to the detent 132 is provided on the surface of the locking part 136 which locates against the inner wall of the channel 109 for engagement with a hole 150 provided therein. The body part 137 incorporates a pair of rollers 138 which are spaced apart sufficiently to accommodate the flange 122 of the runner 120 and provide opposed bearing surfaces therefor. The rollers could alternatively be replaced by fixed bearing surfaces. The body or bearing part 137 thus provides a guide and bearing member for supporting the rear end of the drawer during sliding movement.

When the insert is in position it closes the rear end of the channel 109 and prevents withdrawal of the front guide and bearing member 114. A spring tongue 139 is bent outwardly from the back wall of the locking part 136 of the insert and serves as a resilient member to reduce side movement. This accommodates differences in tolerance of the drawer components arising during manufacture and can be used alone or in conjunction with a spring of the kind shown at 19 in FIG. 2.

Figure 11:
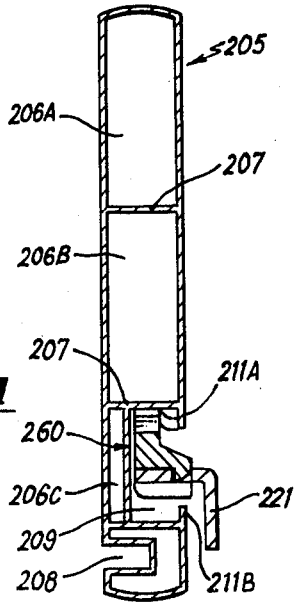
FIG. 11 is a vertical cross-section through a side wall panel of a drawer and associated drawer runner showing the device in position.
Figure 10:
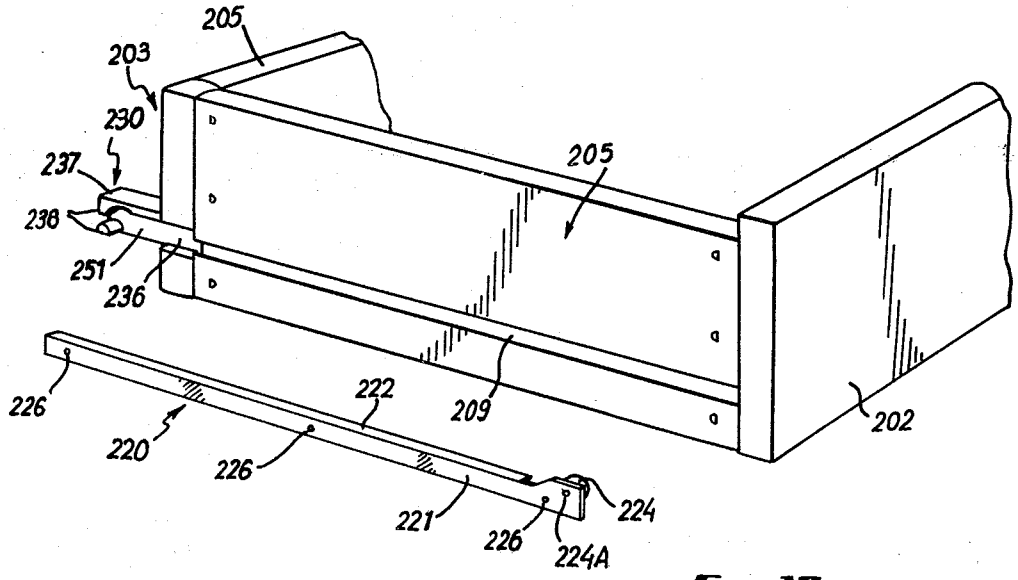
FIG. 10 is a fragmentary perspective view of a drawer and drawer runner of a kind to which the device may be fitted.

Referring now to FIG. 10, there is shown a further form of drawer in which parts similar to those of the drawer shown in FIG. 1 are indicated by similar reference numbers increased by 200. The drawer of FIG. 10 comprises identical hollow extruded side and back wall panels 205 interconnected at right angles to one another by corner pieces 203. The forward ends of the side panels 205 are connected a drawer front 202 by means of end connectors (not shown). As shown in FIG. 11, the side panel 205 comprises upper, intermediate and lower hollow sections 206A, 206B and 206C separated by internal webs 207. The lower hollow section 206C of the panel incorporates an inwardly directed recess 208 adjacent the lower longitudinal edge of the panel to accommodate an edge of a drawer bottom (not shown). The section 206C also incorporates an outwardly directed longitudinal recess or channel 209 the entrance to which is partially closed by upper and lower longitudinal lips 211A, 211B extending across the channel 209 towards one another. The channel 209 consitutes an integral runner track designed to accommodate a drawer runner.

FIG. 10 also shows a drawer runner 220 of angle form and L-shaped cross-section having a vertical mounting flange 221 by means of which the runner may be mounted in a suitable position in a cabinet or like housing in which the drawer is to be slidably located. The runner also has a drawer-engaging flange 222 which projects at right angles from the mounting flange and is adapted to extend into the channel 209. At its forward end the mounting flange 221 is extended and carries a roller 224 rotatable about a horizontal pin 224A. The mounting flange 221 is provided with holes 226 at spaced intervals enabling the runner to be secured in position in the cabinet or like housing in which it is to be mounted in use.

A rear guide and bearing member 230 is mounted at the rear end of the channel 209 and projects rearwardly from the drawer. The member 230 comprises an insert having a locking part 236 which engages with the drawer and a body part 237 which projects to the rear of the drawer. The locking part 236 is provided with a detent (not shown) which engages with a hole in the inner wall of the channel 209 and when the insert is in position the body part 237 projects to the rear of the drawer. The body part incorporates a pair of opposed curved bearing surfaces 238 which are spaced apart sufficiently to accommodate the flange 222 of the drawer runner and provide opposed bearing surfaces therefor. The body or bearing part 237 thus provides a guide and bearing member for supporting the rear end of the drawer on the runner during relative sliding movement thereof.

When the guide and bearing member 230 is in position a downwardly directed opening 251 is left between the bearing surfaces 238 and the rear wall of the drawer, this opening forming an entrance to the channel 209. In this way the drawer may be mounted on the runners by engaging the rollers 224 on the runners at opposite sides of the cabinet or the like in the respective openings 251 and pushing the drawer into the cabinet to engage the rollers in the runner recesses 209. The diameter of the rollers is greater than the spacing between the lips 211A and 211B so that the rollers can only be engaged with and removed from the recesses 209 by way of the gaps 251. The rollers 224 are also capable of limited movement axially of the pins 224A.

In order to compensate for variations in lateral tolerance between the drawer and the runners a device 260 (FIGS. 5 to 9) is mounted on the flange 222 of each runner adjacent to its forward end. Each device 260 comprises a body portion 261 provided with forked portions 262 adapted to embrace the flange 222 of the runner, the forked portions being separated by a downwardly depending lug 263 which engages in a hole 264 formed in the flange 222. The flange 222 is also cut away at 265 to accommodate the forked portions 262 and is provided with an upstanding stop member 266 which, together with the lug 263 prevents axial movement of the device 260 along the runner during use.

Mounted above the forked portions 262 are a pair of upwardly diverging flexible arms 267 each of which carries a laterally projecting resilient tongue 268. When the drawer is located on the runners the arms 267 contact the upper surface of the runner recesses 209 and form a bearing member supplementing the rear guide and bearing member 230. The tongues 268 flex outwardly into contact with the inner surfaces of the upper longitudinal lip 211A of the runner recess and, in association with the similar tongues on the device at the opposite side of the drawer and the axial movement of the rollers 224 on their pins 224A, provide a resilient self-centring effect which takes up lateral play due to variation in tolerance of the drawer and runner components. The device 260 is a one piece molding of plastics materials.

This arrangement provides a simple and effective means for compensating for variations in tolerance of the components of the drawer and runner assembly thereby preventing sloppy movement of the drawer despite manufacturing tolerances. Moreover since the component fitted to the runner is of integral molded construction it does not incorporate any separable parts which could become detached and lost.

Figure 12:
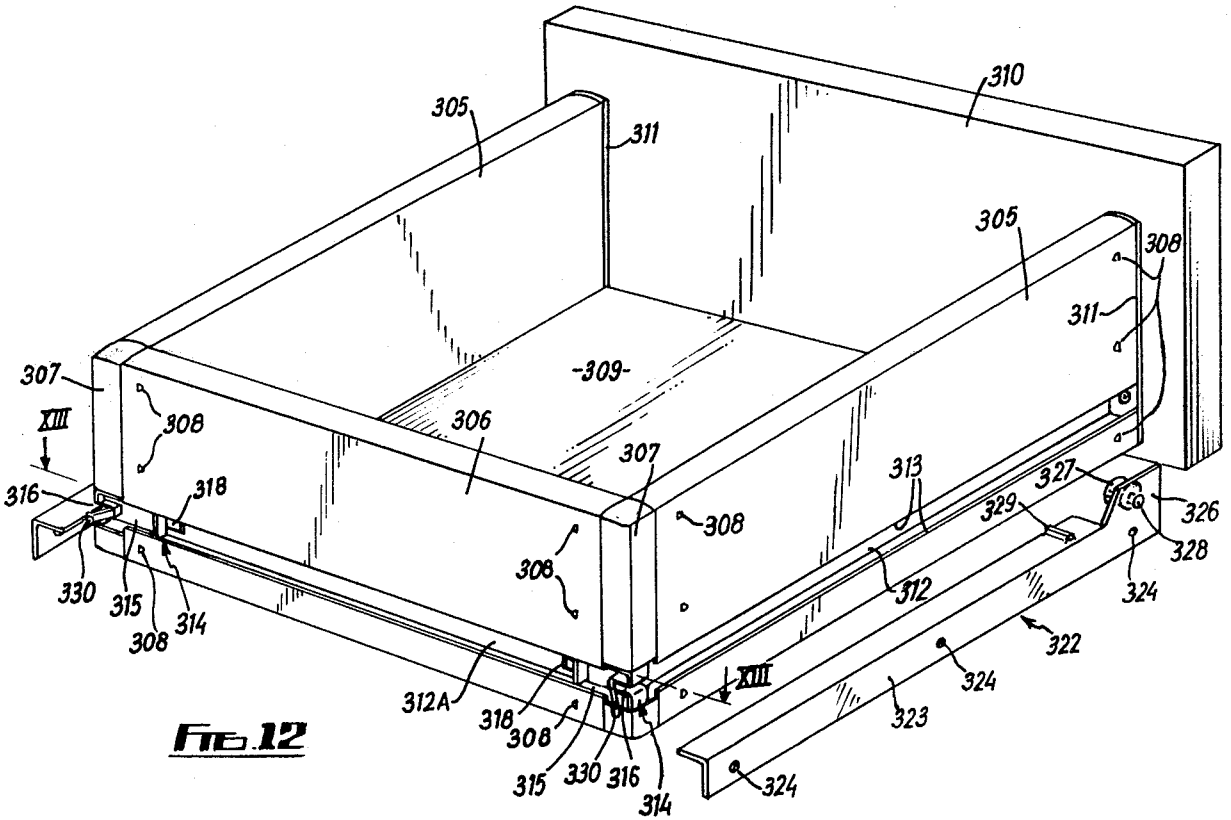
FIG. 12 is a perspective view of a drawer incorporating an alternative form of device for taking up lateral tolerance.
Figure 13:
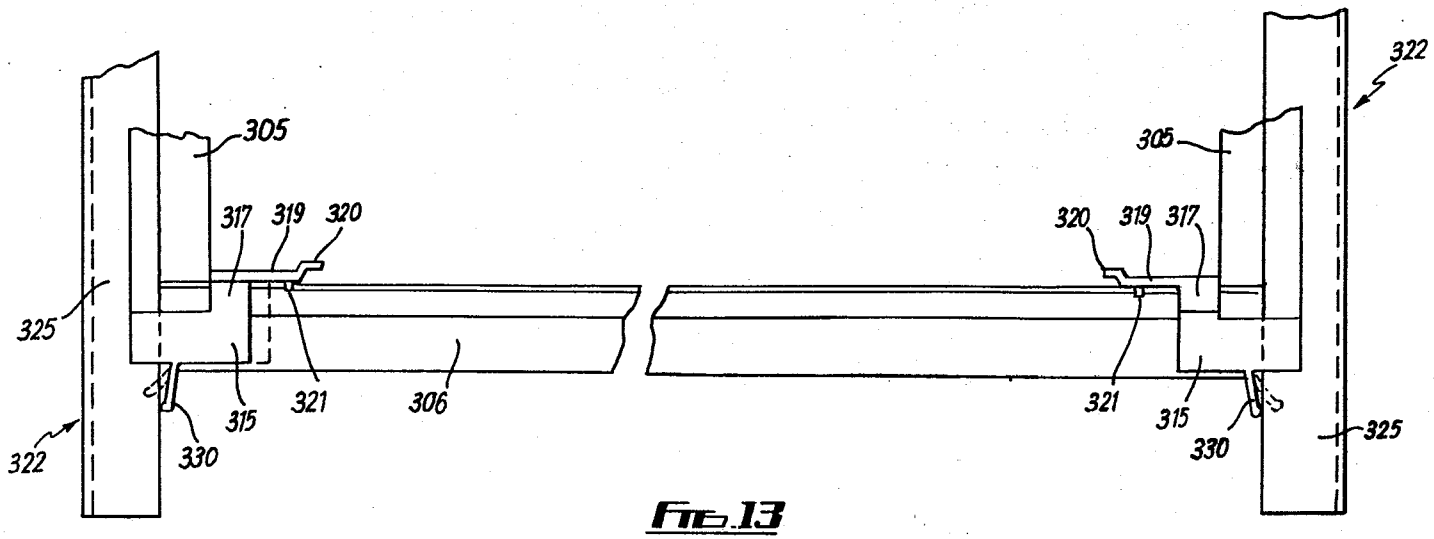
FIG. 13 is a cross-section on the line XIII—XIII in FIG. 12 showing the drawer runners in the position which they occupy in use.

Referring now to FIGS. 12 and 13 there is shown a drawer construction of the kind shown in our co-pending application Ser. No. 923,795, now U.S. Pat. No. 4,186,979. The drawer is similar to that shown in FIG. 10 of the present application and comprises extruded side wall panels 305 and an extruded back wall panel 306 interconnected by corner pieces 307 having spigot members (not shown) projecting therefrom in two directions at right angles and provided with detents 308 which engage in holes adjacent the ends of the associated wall panels to connect them to one another at right angles. The wall panels are provided with inwardly directed slots (not shown) adapted to receive and support the edges of a drawer base 309, and a drawer front 310 is connected to the sides by means of front connectors 311 which are screwed to the rear face of the drawer front and have spigots projecting therefrom which engage in the open ends of the extruded side wall panels 306 and are provided with detents 308 which engage in holes in the side wall panels to secure the drawer front thereto. The drawer front is also provided with a slot to receive and support the forward edge of the drawer base 309.

A longitudinal track or channel 312 is provided in the outer face of each of the side wall panels 305 and has upper and lower lips 313 which project across the mouth of the track 312 towards one another so as to define a relatively narrow entrance to the track. A similar track or channel 312A is formed in the back wall panel 306, and rear guide members 314 are slidably received in the opposite ends of the channel 312A. Each guide member includes a body portion 315 which is retained and guided in the channel 312A by the lips 313 and incorporates an outwardly directed slot 316 adapted to engage with an associated drawer runner. The body portion 315 is connected by means of a slide block 317 (FIG. 13) received in a slot 318 formed in the rear wall of the channel 312A to actuating means in the form of a latch member 319 (FIG. 13), the arrangement being such that the latch member 319 is disposed on the inside of the drawer. The latch member includes a finger piece 320 enabling manipulation of the latch member by the user, and a locking projection 321 which engages with the inner end of the slot 318 to lock the guide member 314 in its operative position shown in FIG. 13. In order to move the guide member to its inoperative position, the finger piece is moved towards the front of the drawer to release the locking projection 321 from engagement with the slot 318, and the latch member 319 may then be pushed towards the centre of the back wall of the drawer to move the guide member 314 to the retracted position shown in FIG. 12.

The drawer is mounted in a cabinet or like supporting structure in which it is to be located in use by means of a pair of runners 322 each of which is of angle section and comprises a mounting flange 323 provided with holes 324 at intervals therealong enabling the runner to be screwed or otherwise secured in a suitable position in the drawer cabinet. The runner also includes a drawer engaging flange 325 projecting at right angles from the mounting flange 323 and adapted to extend into the track 312 in the associated side of the drawer through the narrow entrance thereto. The mounting flange 323 extends beyond the drawer-engaging flange 325 at its forward end and the extension 326 supports a bearing member in the form of a roller 327 rotatably mounted on a pin 328. The axis of the pin 328 lies in the plane of the drawer-engaging flange 325 and the latter is provided with a stop member 329 comprising a projection on the upper surface of the flange adjacent its forward end. The diameter of the roller 327 is such that when engaged in the associated track 312 in the side of the drawer the roller may move along the track but is retained against lateral withdrawal from the track by the projecting lips 313. The roller 327 is also capable of limited movement axially of the pin 328.

In order to take up lateral clearance between the drawer and the runners, each of the guide members 314 is provided with a resilient tongue or finger 330 which is inclined outwardly and rearwardly from the inner end of the slot 316. The finger 330 normally adopts a relaxed position shown in broken lines in FIG. 13 in which it projects to a considerable extent in the lateral direction, but when the drawer is mounted on its runners 222, and the guide members 314 are moved outwards to their operative positions, the inner edges of the drawer-engaging flanges 325 of the runner engage in the slots 316 of the guide members and displace the fingers 330 inwardly to the positions shown in full lines in FIG. 13. The resilient nature of the fingers is such that they tend to urge the drawer away from the respective runners and hence, in conjunction with the axial movement of the rollers, take up lateral clearance between the drawer and the runners and produce a self-centering effect in the same manner as the tongues 268 in the arrangement shown in FIGS. 5 to 9.

Thus in use of the drawer assembly, the runners 322 are mounted in suitable positions in the cabinet or other supporting structure and the latch members 319 are moved inwardly so as to move the guide members 314 to their retracted positions in which they are clear of the rear ends of the tracks 312 in the sides of the drawer. The drawer may then be engaged in the cabinet the rollers 327 entering the tracks 312 from the rear and being retained therein by the lips 313. Once the rollers have been introduced into the tracks, the latch members 319 are moved outwardly, thereby moving the guide members 314 into their operative positions in which they project across the rear ends of the associated tracks 312 and prevent disengagement of the drawer from the rollers. The slots 316 in the guide members 314 engage the drawer-engaging flanges 325 of the associated runners and slidably guide and support the rear end of the drawer on the runners. The resilient fingers 330 also engage the inner edges of the runner flanges 325 and take up lateral clearance between the drawer and the runners. The forward end of the drawer is supported on the rollers 327. When the latches 319 are moved to their outer positions the locking projections 321 drop into engagement with the inner ends of the slots 318 in the rear wall and retain the guide members against inward movement. The drawer may then be moved between open and closed positions at will with the rear end supported on the flanges 323 of the associated runners and the drawer being supported forwardly of the guide members 314 by the rollers 327.

Various modifications may be made without departing from the invention. For example the construction of the front guide and bearing member of the arrangement shown in FIGS. 1 to 4 may be altered and it could incorporate a fixed bearing surface of curved or other form instead of a roller or rollers. If desired a plurality of such guide and bearing members could be provided at spaced intervals along the associated runner; in this event it may be possible to dispense with the rear guide and bearing members.

In the FIGS. 5 to 11 embodiment the flexible tongues could project in the opposite direction so as to act on the inner or back wall of the drawer runner groove. The device could also extend beneath the supporting flange of the runner to engage with the lower longitudinal lip instead of or in addition to the upper lip. If desired projecting tongues or other resilient members may be arranged to engage at one or more points with the inner or back wall of the runner groove in addition to one or more of the longitudinal lips.

In a further modification a plurality of devices for accommodating lateral tolerance may be provided at spaced locations along each runner if required. The roller mounted at the forward end of the runner could be replaced by such a device or by a skid or other member having sliding or rolling contact with the runner recess. The device of FIGS. 5 to 11 could be used in association with a device of the kind shown in FIG. 4 and the device of FIGS. 12 and 13 could be used in association with a device of the kind shown in FIG. 2.

The drawer panels may also be of different construction provided they incorporate integral tracks for engagement with the drawer runners. The tracks are preferably contained within the dimensions of the wall panel itself but could in some instances be fitted to the outer surface thereof. Moreover while in the arrangements described the connecting pieces are held in engagement with the panels by projecting detents engaging in holes in the panels, alternative means of securing the connecting pieces may be used; for example they could be secured in place by adhesive. Moreover though particularly beneficial when used in association with hollow extruded drawer constructions in knock-down form, the invention is also applicable to other forms of drawer.

We claim:

1. A drawer assembly comprising a drawer having opposed side walls, a runner recess in each side wall, each runner recess being provided with opposed longitudinally-extending lips projecting across the mouth thereof, a pair of drawer runners each having a bearing member at its forward end for engagement in the associated runner recess and a horizontal flange slidably engageable with a guide and bearing member at the rear end of the drawer to support same during sliding movement of the drawer and a component mounted on said horizontal flange so as to extend into the runner recess in the drawer, the component incorporating at least one resilient projection adapted to act against the inner face of at least one of said longitudinal lips to apply lateral pressure to the drawer and hence take up lateral clearance between the drawer and the runner.

2. A drawer assembly according to claim 1 wherein a pair of opposed resilient projections are provided on said component which are disposed side-by-side in the same horizontal plane and have their free ends directed towards one another.

3. A drawer assembly according to claim 1 wherein said component includes at least one upwardly directed resilient portion forming an additional bearing surface to support the weight of the drawer during sliding movement.

4. A drawer assembly according to claim 1 wherein said component is detachably mounted.

5. A drawer assembly according to claim 4 wherein said component includes locking means to prevent movement of the component longitudinally of the runner.

6. A drawer assembly according to claim 5 wherein said locking means includes a downwardly directed projection adapted in use to engage in a complementary recess in the runner.

7. A drawer assembly according to claim 5 wherein said locking means includes an abutment on said component adapted for engagement with a stop member provided on the runner.

8. A drawer assembly according to claim 2, 3 or 4 wherein said component is formed as a unitary molding from plastics.

* * * * *